US006019707A

United States Patent [19]

Wang

[11] Patent Number: 6,019,707

[45] Date of Patent: Feb. 1, 2000

[54] CASTERS STRUCTURE FOR TREADMILL RUNNER

[76] Inventor: Leao Wang, No 1, Lane 154, Charng Long Rd., Taiping City, Taichung Hsien, Taiwan

[21] Appl. No.: 09/209,009

[22] Filed: Dec. 11, 1998

[51] Int. Cl.[7] ..... A63B 22/02

[52] U.S. Cl. ..... 482/54

[58] Field of Search ..... 482/51, 54; 16/18 R, 16/19, 45, 18 A

[56] References Cited

U.S. PATENT DOCUMENTS

| | | | |
|---|---|---|---|
| 5,733,228 | 3/1998 | Stevens | 482/54 |
| 5,813,947 | 9/1998 | Densmore | 482/51 |
| 5,830,114 | 11/1998 | Halfen et al. | 482/70 |
| 5,833,577 | 11/1998 | Hurt | 482/54 |
| 5,868,648 | 2/1999 | Coody et al. | 482/54 |

*Primary Examiner*—Glenn E. Richmon
*Attorney, Agent, or Firm*—Dougherty & Troxell

[57] ABSTRACT

A caster structure for treadmill runner which has a runner frame comprised of a master frame, a framework, a running board, a front transverse lever, a hand holder and a floor-type rear prop. The caster assemblies fit in both ends of the transverse lever horizontally installed at the base of master frame and the front transverse lever with a pipe plug by press fitting. A plurality of anchoring holes are drilled in the pipe plug facing outwardly to allow insertion of the axle of the caster assembly. Thus, when the caster assembly is anchored to a lower anchoring hole, the caster contacts the floor surface and enables the treadmill runner be moved. When the caster assembly is anchored in an upper anchoring hole, the caster will not touch the floor surface enabling the treadmill to steadily remain on the floor surface enabling the treadmill to steadily remain on the floor surface without any slippery occurrence.

3 Claims, 4 Drawing Sheets

CASTERS STRUCTURE FOR TREADMILL RUNNER

BACKGROUND OF THE INVENTION

1. Field of the Invention

This invention relates to a caster structure for a treadmill runner. This structure enables the treadmill runner's frame to be pushed directly after its running board and framework have been moved to their upright folding positions.

2. Description of the Prior Art

A treadmill runner is a track type sport facility used for indoor exercise. Its typical assembly is to have one floor-type front prop and one floor-type rear prop installed at front and rear ends of the treadmill runner's framework. The running board can be set to demonstrate a slightly tilted status when the placement of the framework is done. At this moment, the user can run on the running track to do the running exercise. When storage or transportation of the treadmill runner by folding is desired, the user can flip the running board into an upright folding position to lessen its space occupation.

In a known treadmill design (as shown on FIG. 1), after running board 12 is lifted to a vertical status, its floor-type front prop 14 will become the supporting point and will bear the total weight of runner frame 10. Afterward, there are caster assemblies 16 equipped on both ends of one side of the floor-type prop 14. Therefore, moving the runner frame 10 can be done by just simply slanting runner frame 10 in an adequate angle and letting the caster assemblies touch floor 18 to perform their work (as shown by dashed lines in the figure), and then smoothly pushing runner frame 10. The integrated weight of runner frame 10 is not a light weight. When it is tilted to its push-to-move position, the floor-type prop 14 has completely separated from floor 18 leaving the caster assemblies 16 as the only supporting points. Under these circumstances, runner frame 10 may fall down onto the ground 18 due to user's careless incident or obstacles on the ground while the user is pushing the runner frame 10 without paying special attention to the surrounding environment. As a result, this may seriously damage the runner frame 10 and hurt the user.

SUMMARY OF THE INVENTION

By taking the aforementioned facts into account, the inventor has applied his long-term pragmatic experience to create a runner frame that has a free pushing movement without tilting the runner frame when the treadmill runner is folded in a vertical status. Therefore, there is no falling and casualty incident and the safety will be further secured during the pushing and sliding motion.

BRIEF DESCRIPTION OF THE DRAWINGS

For the purpose of better understanding the technical approach and its associated characteristics of structure, a series of figures with brief description is listed below.

DETAILED DESCRIPTION OF THE PREFERRED EMBODIMENT

Figure 1:
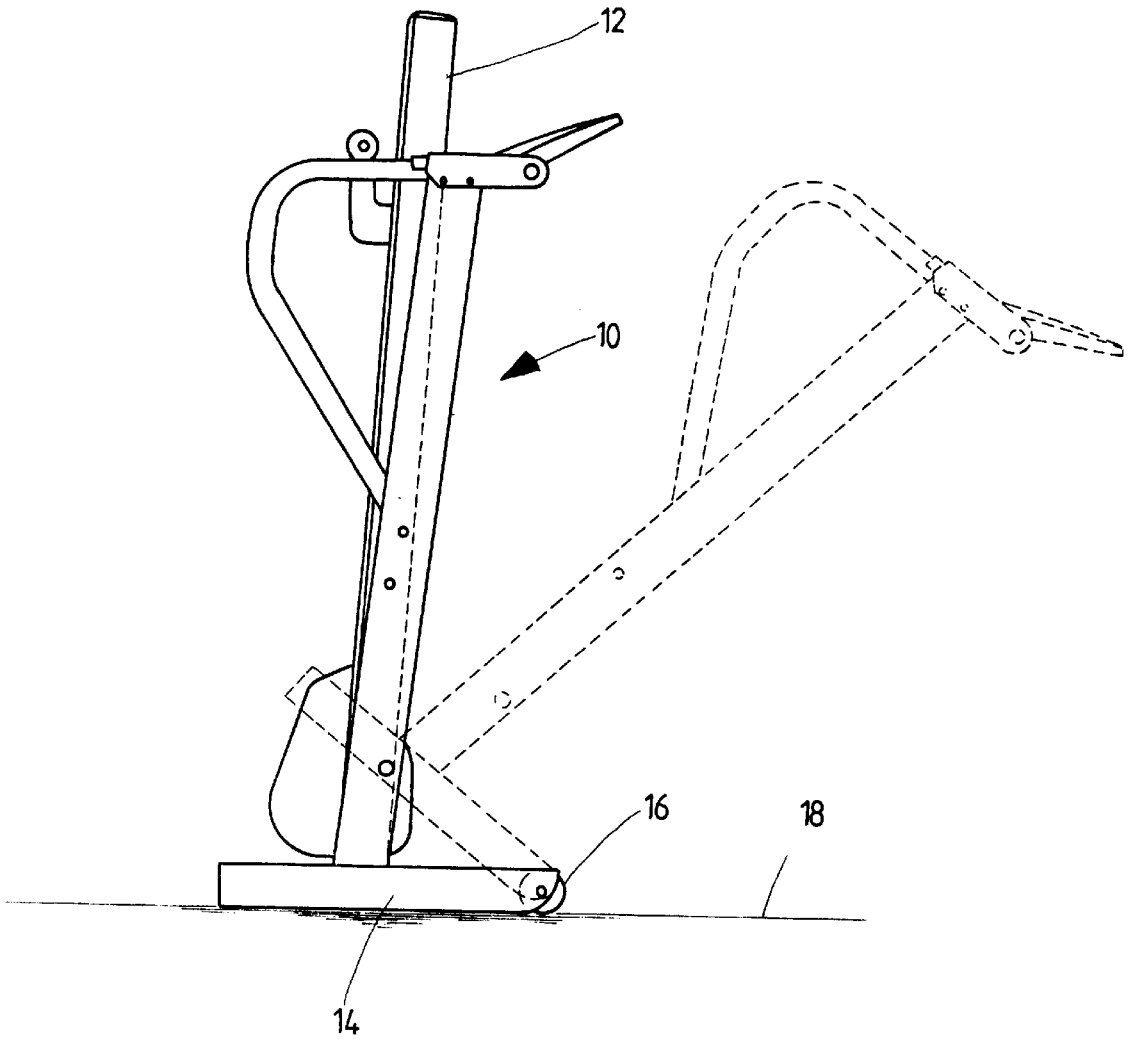
FIG.1 PRIOR ART
FIG. 1 is a side view of a known treadmill structure.
Figure 2:
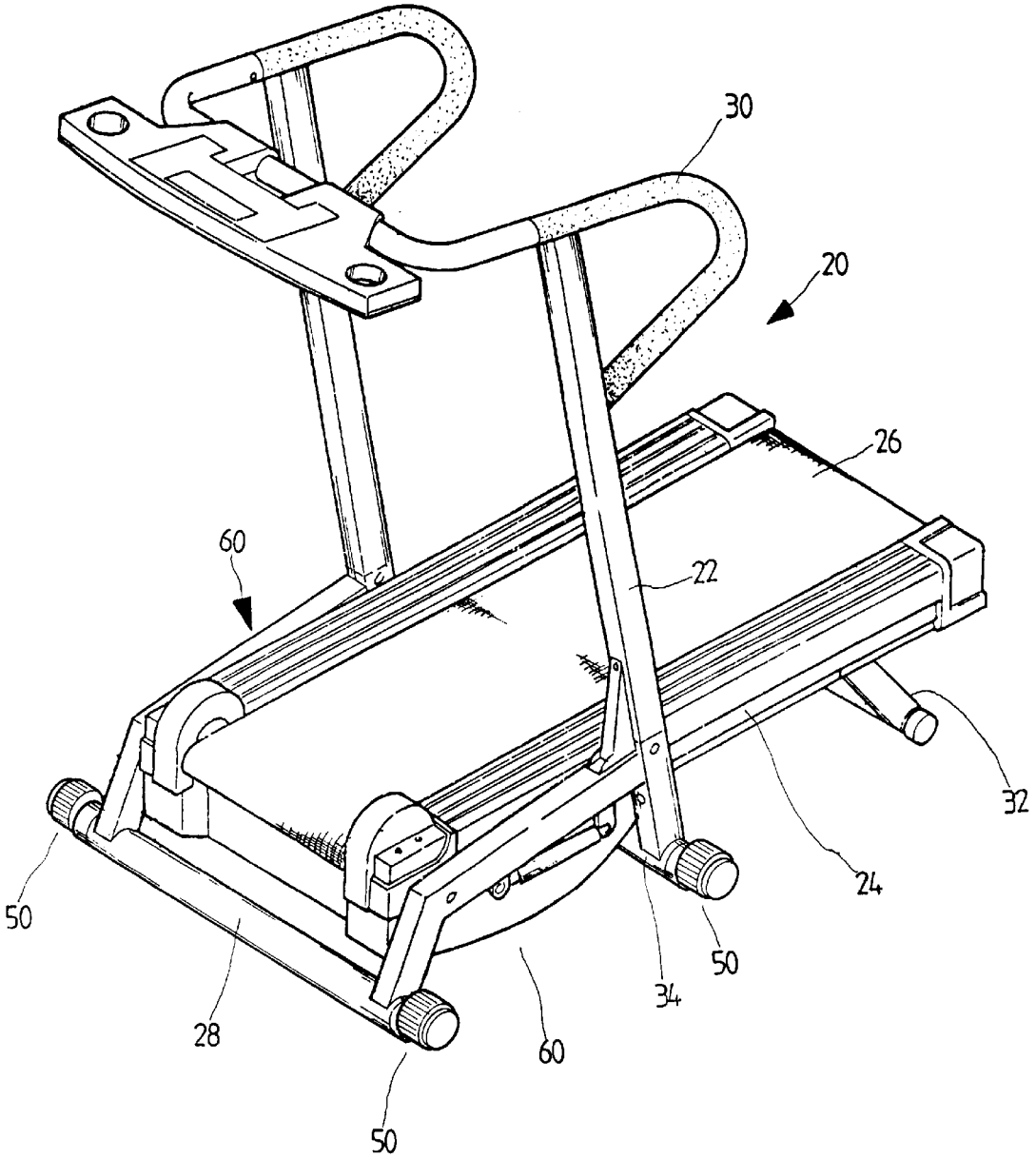
FIG. 2 is a perspective view of a treadmill assembly of this invention.

Referring to FIG. 2, the runner frame of treadmill runner 20 comprises a master frame 22, a framework 24, a running board 26, a front transverse lever 28, a hand holder 30 and a floor-type rear prop 32. A transverse lever 34 is installed transversely at the base of master frame 22 parallel to front transverse lever 28 to form together a supporting frame assembly 60. It can effectively and steadily support the treadmill runner 20 while the running board 26 and framework 24 are lifted and folded in a vertical position. Certainly, this supporting frame assembly 60 can be incorporated with a floor-type rear prop 32 to effectively support treadmill runner 20 after running board 26 and framework 24 are horizontally placed to their stand-by position for immediate use so that user can stand on the running board 26 and start his running exercise.

Figure 3:
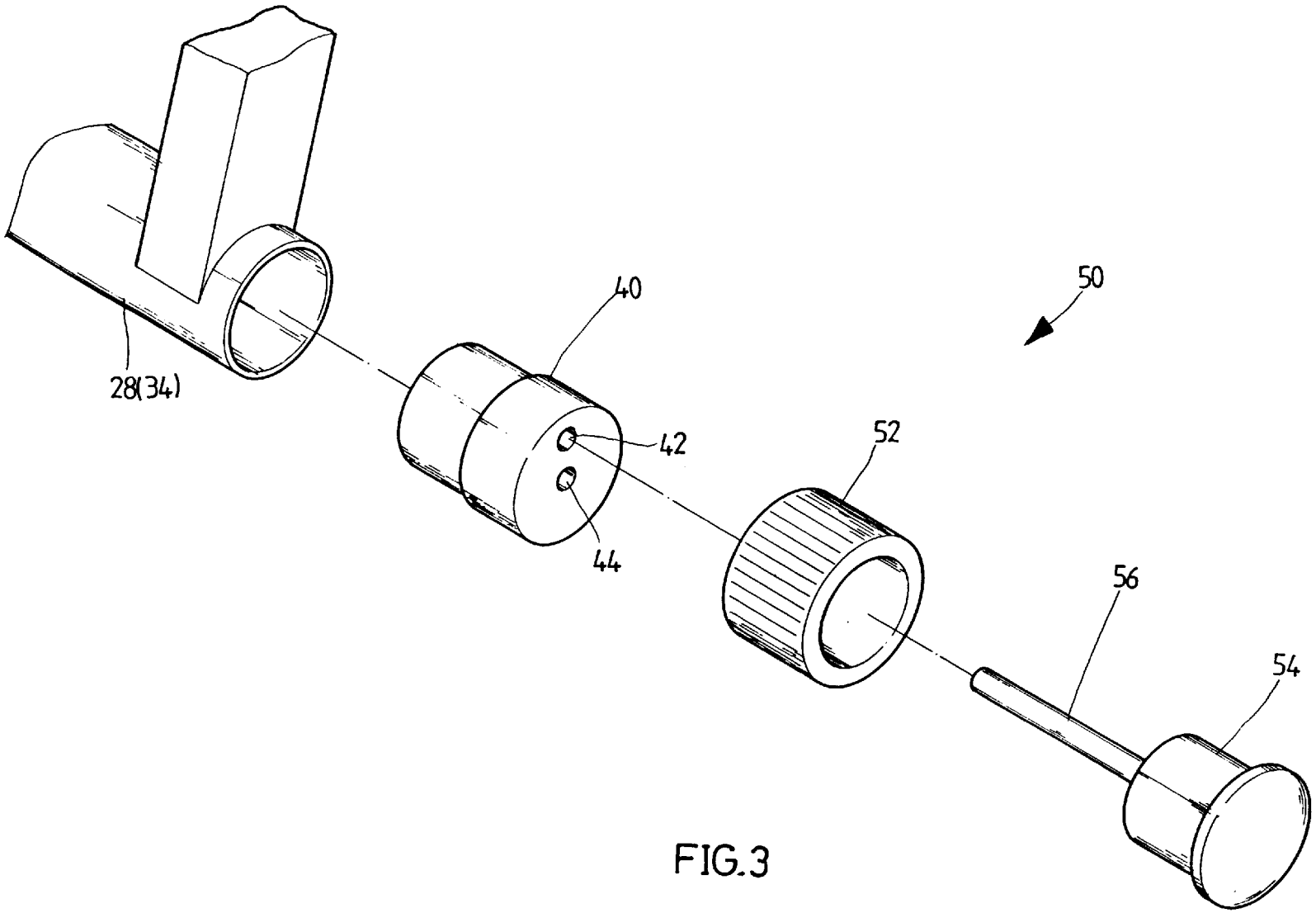
FIG. 3 is an exploded perspective view of a caster of this invention.
Figure 4:
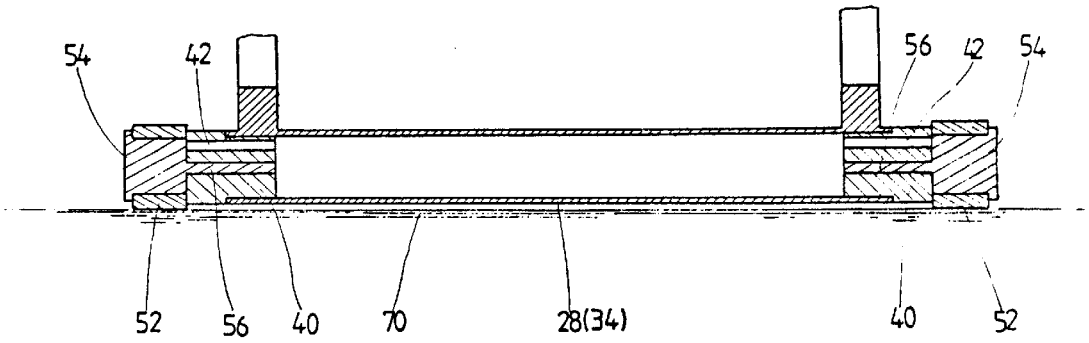
FIG. 4 is a cross-sectional view of a transverse supporting having caster assembly of this invention with the casters in a first position.
Figure 5:
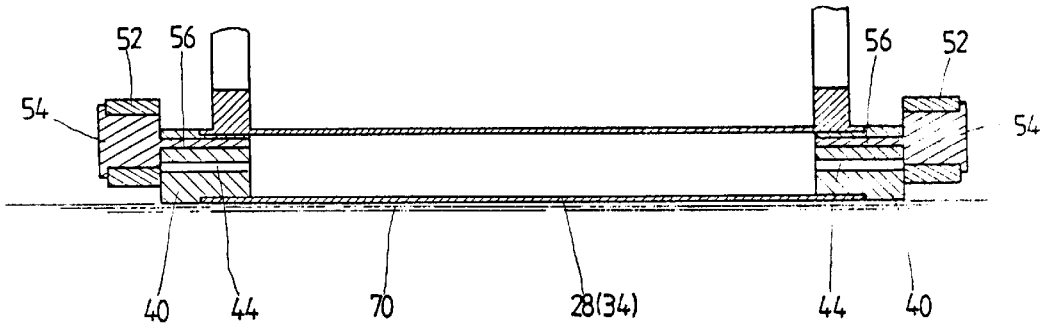
FIG. 5 is a cross-sectional view similar to FIG. 4 showing the casters in a second position.

Referring to FIG. 3, FIG. 4 and FIG. 5, the caster of this invention fits into both ends of the transverse lever 34 horizontally installed at the base of master frame 22 and front transverse lever 28. A pipe plug 40 is fit into end of lever 34 and 28 with anchoring holes 42 and 44 drilled in pipe plug 40 facing outward respectively where inserting axle 56 of caster assembly 50 can be anchored. Thus, when caster assembly 50 is anchored in the lower anchoring hole 44 at pipe plug 40, the caster can contact floor surface 70 and enable the runner frame 20 to move. When caster assembly 50 is anchored to the upper anchoring hole 42, the caster will not touch the floor surface 70 enabling treadmill runner 20 to steadily remain on floor surface 70 without any slippery occurrence.

The caster assembly 50 is comprised of a caster 52 and an axle retainer 54 with an insertion stud 56 fitted to the inner end-face of axle retainer 54. Therefore, the user can unplug the caster assembly 50 and again plug it into any one of the anchoring holes 42 and 44 in pipe plug 40 according to the desired usage so that moving the treadmill runner 20 or keeping the treadmill runner 20 steadily on floor can be accomplished. The caster assembly is convenient and practical.

As can be seen, this invention fulfills the "newly invented" and "progressive" requirements with respect to it practical values. It indeed is qualified to the prerequisite required for new patent application.

I claim:

1. A caster for a treadmill having a master frame connected to a framework with a running board movably mounted thereon, the caster comprising:

a) at least one transverse lever on the master frame;

b) a plug attached to each opposite end of the at least one transverse lever, each plug having first and second anchoring holes spaced apart from each other; and c) a caster assembly having a movable caster located on an axle retainer, the axle retainer having an insertion axle extending therefrom, the insertion axle removably inserted into one of the first and second spaced apart anchoring holes such that, when the insertion axle is inserted into the first anchoring hole, the movable caster is out of contact with a support surface, and when the insertion axle retainer is inserted into the second hole, the movable caster contacts the support surface to support the treadmill thereon enabling the treadmill to be moved on the support surface.

2. The caster of claim 1 wherein the plugs are press fit into the ends of the at least one transverse lever.

3. The caster of claim 1 further comprising two transverse levers on the master frame, each transverse lever having opposite ends with a caster located on each end of each transverse lever.

* * * * *